US011348560B1

(12) United States Patent
Davis et al.

(10) Patent No.: US 11,348,560 B1
(45) Date of Patent: May 31, 2022

(54) SELECTIVELY SECURABLE MUSICAL INSTRUMENT HOLDER APPARATUS AND METHOD

(71) Applicants: Clare Marie Davis, Pensacola, FL (US); Virginia Lee Yeagle, Gulf Breeze, FL (US)

(72) Inventors: Clare Marie Davis, Pensacola, FL (US); Virginia Lee Yeagle, Gulf Breeze, FL (US)

( * ) Notice: Subject to any disclaimer, the term of this patent is extended or adjusted under 35 U.S.C. 154(b) by 0 days.

(21) Appl. No.: 16/942,987

(22) Filed: Jul. 30, 2020

Related U.S. Application Data

(60) Provisional application No. 62/882,212, filed on Aug. 2, 2019.

(51) Int. Cl.
*G10G 5/00* (2006.01)

(52) U.S. Cl.
CPC ..... *G10G 5/00* (2013.01)

(58) Field of Classification Search
None
See application file for complete search history.

(56) References Cited

U.S. PATENT DOCUMENTS 3,266,766 A * 8/1966 Linville, Jr. ..... G10G 5/00 248/688
3,581,354 A * 6/1971 Usiskin ..... G01B 5/0002 24/569
5,027,478 A * 7/1991 Suhr ..... F16L 3/223 24/16 R
D372,419 S * 8/1996 Ikegami ..... D8/382
D395,815 S * 7/1998 Walters ..... D8/354
6,143,970 A * 11/2000 Kowzan ..... G10D 3/046 211/70.1
9,920,858 B2 * 3/2018 Harnetiaux ..... B60R 16/0215
9,951,888 B2 * 4/2018 Boriack ..... A01C 7/208
2003/0173470 A1 * 9/2003 Geiger ..... F16L 55/035 248/55
2009/0272576 A1 * 11/2009 Medina ..... B60R 16/0215 174/72 A
2019/0019481 A1 * 1/2019 Klein ..... G10G 7/00

* cited by examiner

*Primary Examiner* — Steven M Marsh
(74) *Attorney, Agent, or Firm* — J. Nevin Shaffer, Jr.

(57) ABSTRACT

A selectively securable musical instrument holder apparatus consisting of a support platform with a top, a bottom and a side. An attachment recess is provided from the top to the bottom of the support platform where the attachment recess includes a slot in the side of the support platform. A hole is provided in the support platform where the hole is configured to receive a musical instrument, where the musical instrument has a bore and a first end and a second end, and the hole is configured to support the first end of the musical instrument above the top of the support platform. A stand connector is provided where the stand connector is located in the attachment recess such that the support platform is selectively securable to a stand when the stand is located in the recess.

20 Claims, 5 Drawing Sheets

SELECTIVELY SECURABLE MUSICAL INSTRUMENT HOLDER APPARATUS AND METHOD

CROSS REFERENCE TO RELATED APPLICATION

This application claims the benefit of previously filed U.S. provisional patent application No. 62/882,212 filed Aug. 2, 2019 for a "Selectively Securable Recorder Holder Apparatus and Method". The Applicant hereby claims the benefit of this provisional application under 35 U.S.C. § 119. The entire content of this provisional application is incorporated herein by this reference.

FIELD OF THE DISCLOSURE

The present invention pertains to a selectively securable musical instrument holder apparatus consisting of a support platform with a top, a bottom and a side. An attachment recess is provided from the top to the bottom of the support platform where the attachment recess includes a slot in the side of the support platform. A hole is provided in the support platform where the hole is configured to receive a musical instrument, where the musical instrument has a bore and a first end and a second end, and the hole is configured to support the first end of the musical instrument above the top of the platform. A stand connector is provided where the stand connector is located in the attachment recess such that the support platform is selectively securable to a stand when the stand is located in the recess.

BACKGROUND OF THE INVENTION

Sometimes a person is using one device but needs quick access to another device. The problem is how to keep the other device handy, safe and secure but easily accessible. By way of example only and not by limitation, when performing with musical instruments, particularly wind instruments such as recorders (a musical instrument, of which there are many sizes, such as, for example, soprano, alto and tenor), there is a need for a safe, convenient and visible way to rest the musical instrument when not in use while making the resting musical instrument accessible to the musician when performing.

The current state of the art "solution" is a peg board on the ground, typically, at the musician's feet. Musical wind instruments, such as recorders, for example only and not by way of limitation, are held in place by inserting the peg into the bore of the recorder. In fact, the recorders are not really "handy" as the user must stoop or reach down to retrieve one and replace another. Also, the peg board is subject to being kicked inadvertently placing the recorders at risk for damage. Further, the insertion of the peg into the bore of the recorder can damage and deface the recorder.

Thus, there is a need in the art for an apparatus and method for holding musical instruments, such as recorders, in a safe, easily accessible and visible manner and that is capable of accommodating a full spectrum of musical instrument shapes and dimensions.

It therefore is an object of this invention to provide an improved selectively securable musical instrument holder that is easy to use and economical to install and operate.

SUMMARY

Accordingly, a selectively securable musical instrument holder apparatus and method according to a preferred embodiment consists of a support platform with a top, a bottom and a side. An attachment recess is provided from the top to the bottom of the support platform where the attachment recess includes a slot in the side of the support platform. A hole is provided in the support platform where the hole is configured to receive a musical instrument, where the musical instrument has a bore and a first end and a second end, and the hole is configured to support the first end of the musical instrument at the top of the support platform. A stand connector is provided where the stand connector is located in the attachment recess such that the support platform is selectively securable to a stand when the stand is located in the attachment recess.

In one aspect, the musical instrument is a recorder and, in another aspect, the hole is configured to support a recorder selected from a group of recorders consisting of: soprano, alto and tenor.

In one aspect, the invention further includes more than one hole in the support platform and in another aspect, there are three holes in the support platform. In a further aspect, the musical instrument is a recorder and the three holes are configured to receive and support different sizes of a recorder. In another aspect, the three holes are configured to receive one each of a selection of recorders consisting of a soprano, an alto and a tenor recorder.

In one aspect, the support platform consists of a connection arm where the attachment recess is in the connection arm and a support platform where the hole in the support platform also includes a slot in the side such that a length of the musical instrument fits between the slot and into the hole.

In another aspect, the support platform is curved with a circular dimension.

According to another embodiment, a selectively securable recorder holder apparatus consists of a support platform with a top, a bottom and a side. An attachment recess is provided from the top to the bottom in the support platform where the attachment recess includes a slot in the side. A hole is provided in the support platform where the hole is configured to receive a recorder, where the recorder has a bore and a first end and a second end, and the hole is configured to support the first end of the recorder at the top of the support platform. A stand connector is provided where the stand connector is located in the attachment recess such that the support platform is selectively securable to a stand when the stand is located in the attachment recess.

In one aspect, the hole is configured to support a recorder selected from a group of recorders consisting of: soprano, alto and tenor.

In one aspect, there are more than one hole in the support platform. In another aspect, there are three holes in the support platform and, in a further aspect, the three holes are configured to receive and support different sizes of a recorder. In another aspect, the three holes are configured to receive one each of a selection of recorders consisting of a soprano, an alto and a tenor recorder.

In one aspect, the support platform consists of a connection arm where the attachment recess is in the connection arm and a support platform where the hole in the support platform also includes a slot in the side such that a length of the recorder fits between the slot and into the hole.

In another aspect, the support platform is curved with a circular dimension.

According to another embodiment, a method for selectively securing a recorder in a holder consists of:

a. providing a support platform with a top, a bottom and a side; an attachment recess in the support platform where the attachment recess includes a slot in the side; a hole in the support platform where the hole is configured to receive a recorder, where the recorder has a bore and a first end and a second end, the hole configured to support the first end of the recorder at the top of the platform; and b. providing a stand connector where the stand connector is located in the attachment recess such that the support platform is selectively securable to a stand when the stand is located in the recess.

In one aspect, the hole is configured to support a recorder selected from a group of recorders consisting of: soprano, alto and tenor.

In another aspect, there are three holes configured to receive a soprano recorder, an alto recorder and a tenor recorder.

DESCRIPTION OF THE DRAWINGS

Other objects, features and advantages of the present invention will become more fully apparent from the following detailed description of the preferred embodiment, the appended claims and the accompanying drawings in which:

DETAILED DESCRIPTION OF EMBODIMENTS

Figure 1:
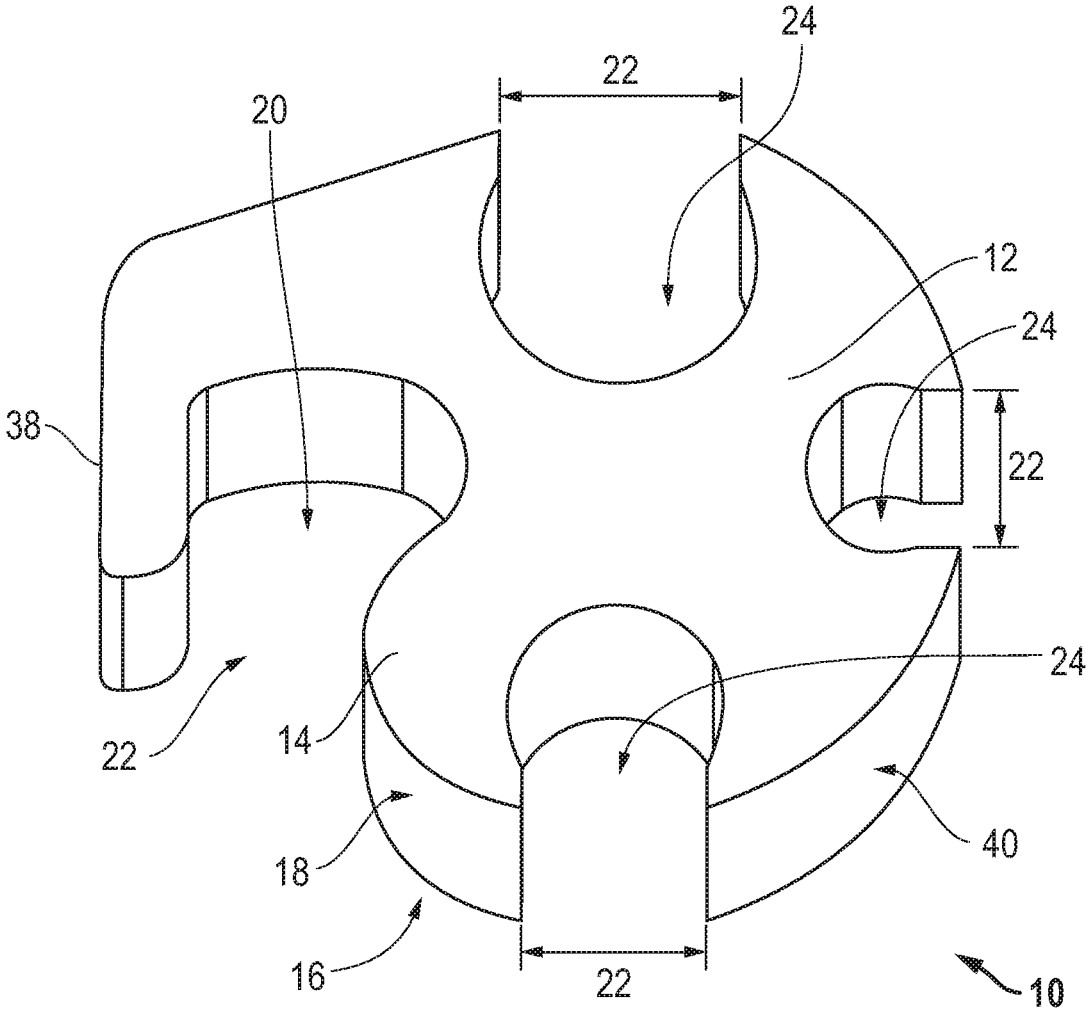
FIG. 1 is a perspective view of the selectively securable musical instrument holder without the stand connector.

Before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the invention be regarded as including equivalent constructions to those described herein insofar as they do not depart from the spirit and scope of the present invention.

For example, the specific sequence of the described method may be altered so that certain processes are conducted in parallel or independent, with other processes, to the extent that the processes are not dependent upon each other. Thus, the specific order of steps described herein is not to be considered implying a specific sequence of steps to perform the process. In alternative embodiments, one or more process steps may be implemented by a user assisted process and/or manually. Other alterations or modifications of the above processes are also contemplated. For example, further insubstantial approximations of the process and/or algorithms are also considered within the scope of the processes described herein.

In addition, features illustrated or described as part of one embodiment can be used on other embodiments to yield a still further embodiment. Additionally, certain features may be interchanged with similar devices or features not mentioned yet which perform the same or similar functions. It is therefore intended that such modifications and variations are included within the totality of the present invention.

It should also be noted that a plurality of hardware devices, as well as a plurality of different structural components, may be utilized to implement the invention. Furthermore, and as described in subsequent paragraphs, the specific configurations illustrated in the drawings are intended to exemplify embodiments of the invention and that other alternative configurations are possible.

One embodiment of the present invention is illustrated by way of example in FIGS. 1-5. With specific reference to FIG. 1, selectively securable musical instrument holder apparatus and method 10 has a support platform 12 with a top 14, a bottom 16 and a side 18. An attachment recess 20 is provided from and through the top 14 to the bottom 16 of the support platform 12 where the attachment recess 20 preferably includes a slot 22 in the side 18 of the support platform 12.

All terms used herein are given their common meaning. Thus, "musical instrument" describes instruments for making music and, in particular, wind instruments such as recorders that have a bore 28 and a first end 30 with a mouth piece. Further, "support platform" describes a generally flat surface used to hold things in place, such as a table top for example only. As illustrated "attachment recess" 20 is a cut out portion in the support platform and "slot" 22 is a cut out portion of the side 18 of the support platform 12 that connects with the attachment recess as will be more fully described hereafter.

A hole 24 is provided in the support platform 12 where the hole 24 is configured to receive a musical instrument 26 (not shown, See FIG. 3), where the musical instrument 26 has a bore 28 and a first end 30 and a second end 32, and the hole 24 is configured to support the first end 30 of the musical instrument 26 at and/or above the top 14 of the support platform 12. Here the term "hole" describes an empty place or cut out in the support platform 12 as illustrated. Likewise, again, the term "musical instrument" describes and includes any musical instrument with a bore 28, such as a trumpet, flute, and the like, that can be inserted into hole 24 and retained at the top 14.

Preferably there are holes 24 in and through the top 14 of support platform 12 as illustrated where the holes 24 are different dimensions or circumferences such that musical instruments of different sizes with different circumferences are accommodated. For example only, soprano, alto and tenor sized recorders with small, medium and large diameters fit within small, medium and large holes 24.

Figure 2:
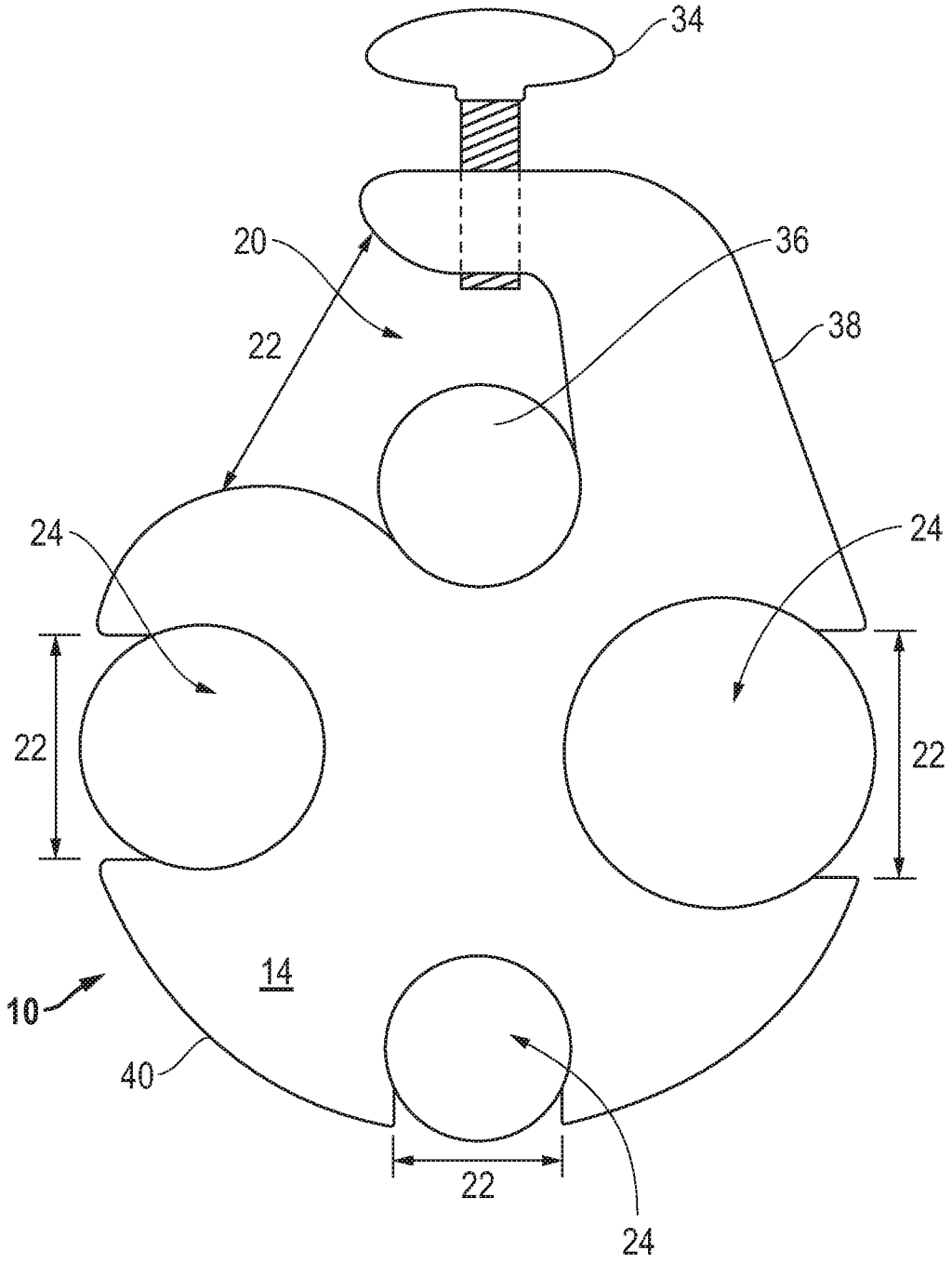
FIG. 2 is a top view of the invention of FIG. 1 including the stand connector.

Referring now to FIG. 2, stand connector 34 is shown where the stand connector 34 is located in the attachment recess 20 such that the support platform 12 is selectively securable to a stand 36 (not shown, see FIG. 3) when a portion or length of the stand 36 is located in the attachment recess 20. Stand connector 34 may be a knob with a screw shaft that passes through the side of support platform 12 and into attachment recess 20, as shown, and connects to stand 36 so as to selectively secure the invention to the stand 36 at any selected and desired location along the length of the stand 36. Thus, a user is enabled to place the musical instruments at a visible location above the ground for easy access. Any other stand connector 36 construction that provides for selective securement is anticipated by and included in the invention as just described.

Still referring to FIG. 2, by way of further description, in one aspect the support platform 12 can be seen to consist of a connection arm 38, where the attachment recess 20 is formed by the connection arm 38. Preferably support platform 12 is a curved support platform 40, much like an artist's pallet such that multiple musical instruments 26 are supported in a small circumferential area. Preferably, the hole (s) 24 in the support platform 12 include a slot 22 connected with holes 24 in the side 18 such that a length of the recorder 26 fits between and within the slot 22 and into hole 24. The slots 22 are sized to accommodate recorders 26 with different circumferences where the first end 26, the playing end, mouth piece, the user blows into, is wider than the hole 24 and thus the recorder 26 is supported at the top 14 of the support platform 12. In some cases, depending on the musical instrument, no slot 22 may be required.

Figure 3:
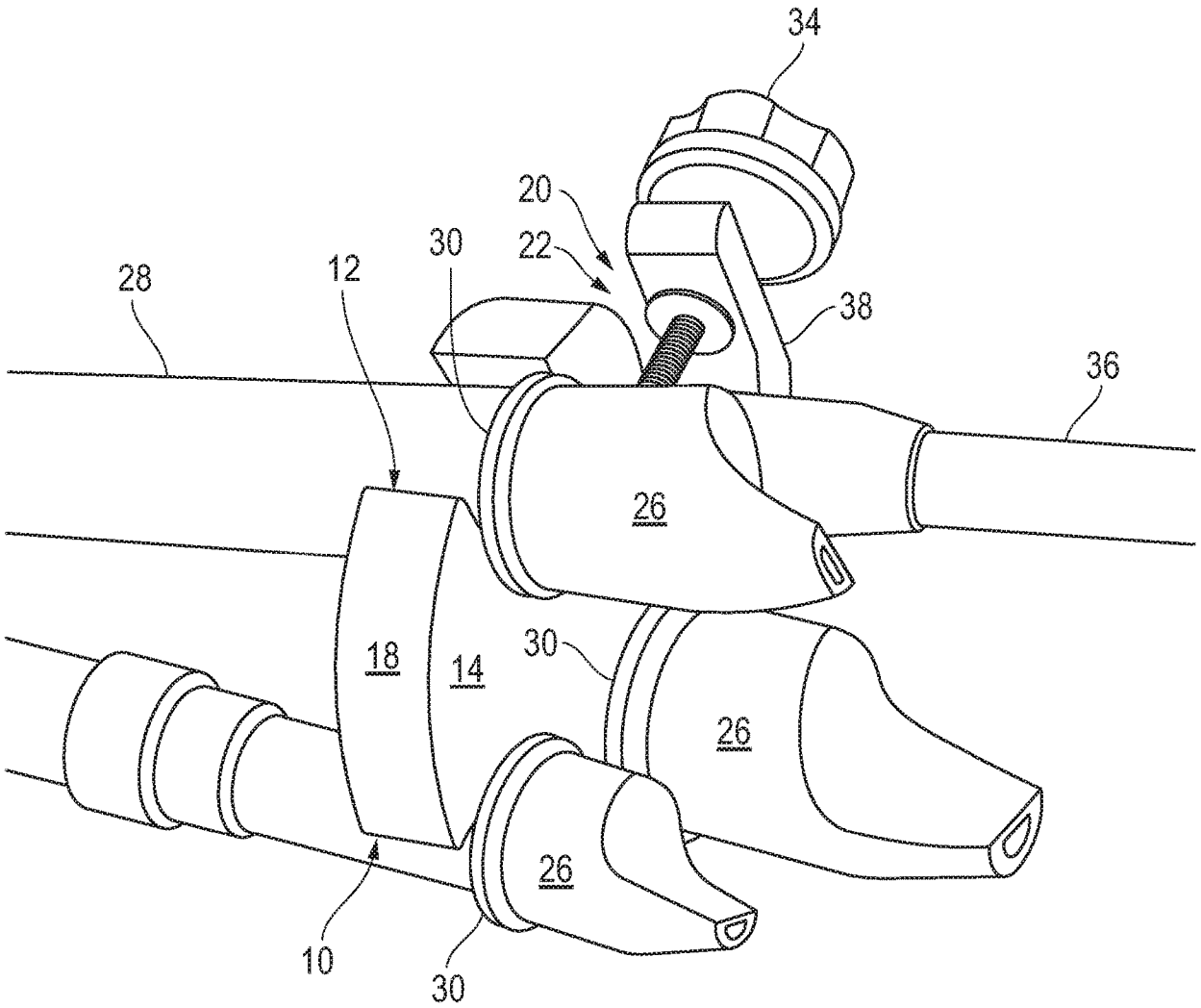
FIG. 3 shows the invention of FIG. 1 attached to a stand with recorders in place.
Figure 4:
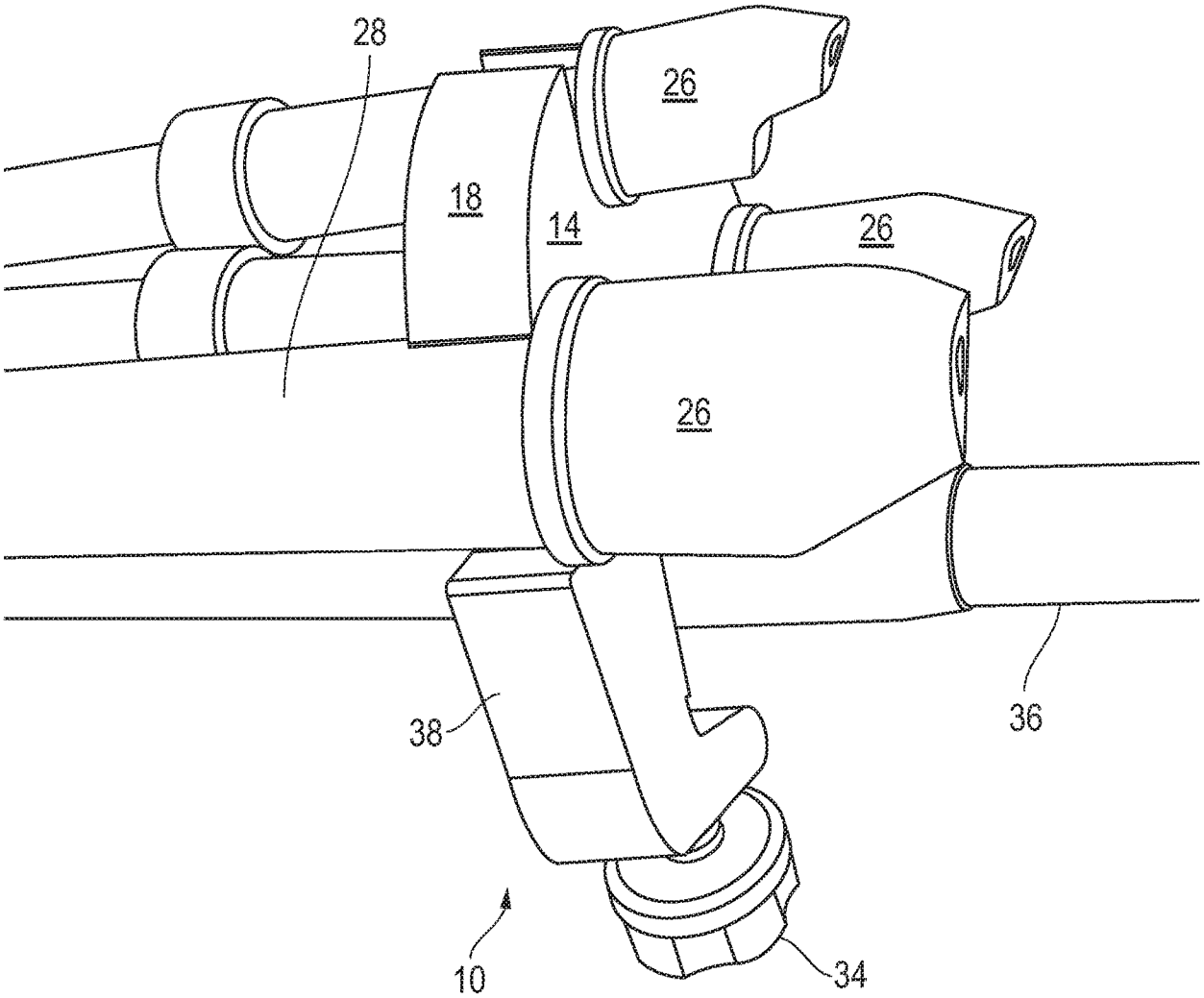
FIG. 4 shows the invention of FIG. 3 from a different side.
Figure 5:
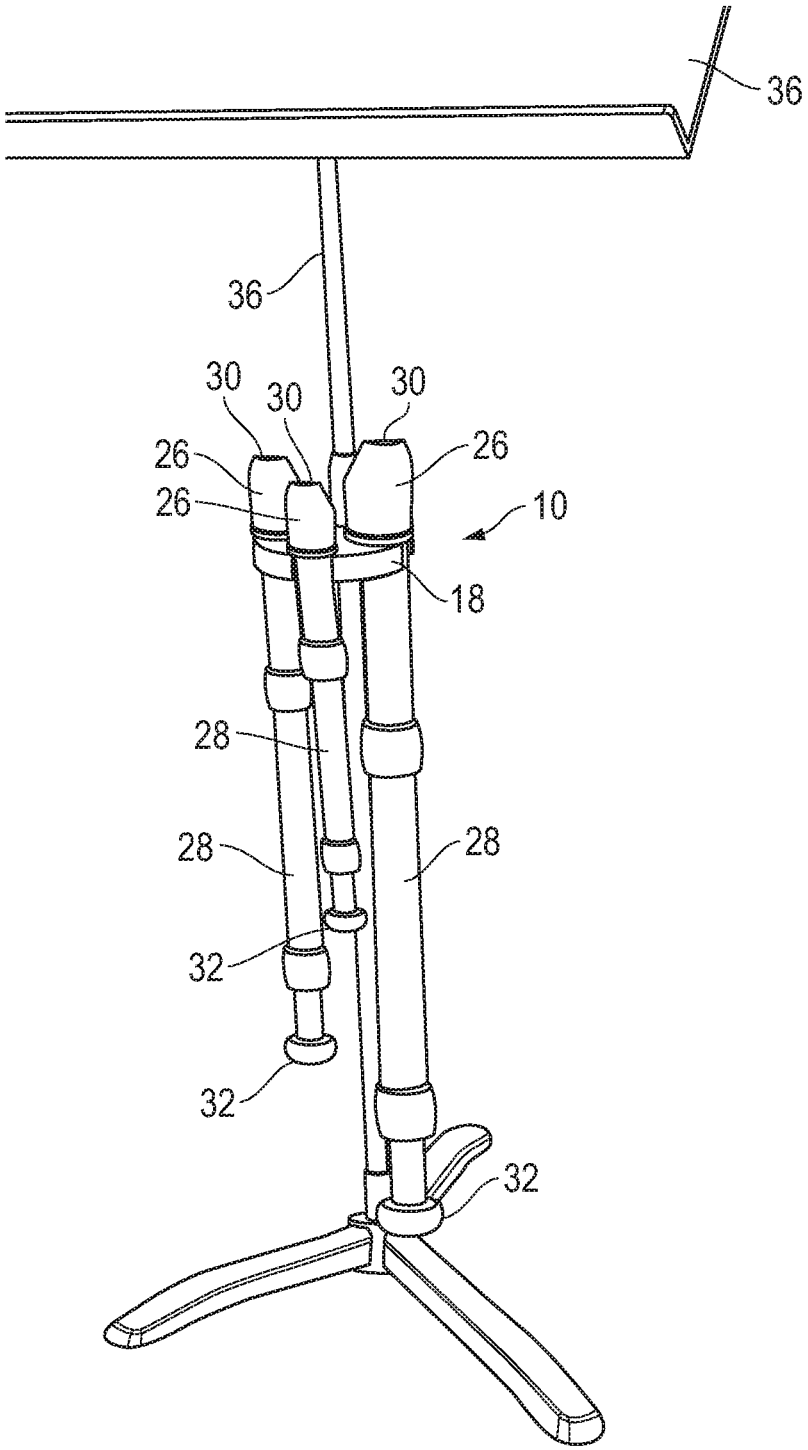
FIG. 5 shows the invention of FIG. 4 from a distance.

Referring now to FIGS. 3, 4 and 5, the support platform 12 is shown connected by stand connector 34 to stand 36. The same elements of the invention as described above are identified by the same numbers for consistency. Again, by means of the connector 34, the present invention provides a selectively securable musical instrument holder 10 that enables a user to select the perfect height to support his or her musical instrument above the ground for ease of access and prevention of harm to the instrument. That is, the musical instrument is held directly in front of the performer in their line of sight in an elevated space above the ground easily accessed and out of harm's way.

The description of the present embodiments of the invention has been presented for purposes of illustration, but is not intended to be exhaustive or to limit the invention to the form disclosed. Many modifications and variations will be apparent to those of ordinary skill in the art. As such, while the present invention has been disclosed in connection with an embodiment thereof, it should be understood that other embodiments may fall within the spirit and scope of the invention as defined by the following claims.

What is claimed is:

1. A selectively securable musical instrument holder apparatus comprising:

a. a support platform with a top, a bottom and a side;

b. an attachment recess from the top to the bottom in said support platform and integral to said support platform where said attachment recess includes an attachment recess slot in the side;

c. a hole in said support platform and a support platform slot connected with said hole where said hole is configured to receive a musical instrument, where the musical instrument has a bore and a first end and a second end and a length and a top, wherein the support platform slot is narrower than the hole and is configured to allow a narrow portion of the length of said musical instrument to pass into the hole wherein the hole is larger than the support platform slot and is smaller than the top of the musical instrument such that the first end of the musical instrument is supported by the top of the support platform; and d. a stand connector where the stand connector is located in the attachment recess such that the support platform is selectively securable to a stand when said stand is located in said attachment recess.

2. The apparatus of claim 1 wherein the musical instrument is a recorder.

3. The apparatus of claim 2 wherein the hole is configured to receive a recorder selected from a group of recorders consisting of: soprano, alto and tenor.

4. The apparatus of claim 1 further including more than one hole in said support platform.

5. The apparatus of claim 4 wherein there are three holes in said support platform.

6. The apparatus of claim 5 wherein the musical instrument is a recorder and wherein the three holes are configured to receive different sizes of a recorder.

7. The apparatus of claim 6 wherein the three holes are configured to receive one each of a selection of recorders consisting of a soprano, an alto and a tenor recorder.

8. The apparatus of claim 1 wherein the support platform further includes a connection arm integral to the support platform where the attachment recess is in said connection arm.

9. The apparatus of claim 8 wherein the support platform is curved with a circular dimension.

10. A selectively securable musical instrument holder apparatus comprising:

a. a support platform with a top, a bottom and a side wherein the support platform is curved with a circular dimension;

b. an attachment recess integral to the support platform from the top to the bottom in said support platform where said attachment recess includes an attachment recess slot in the side;

c. a hole in said support platform and a support platform slot connected with said hole where said hole is configured to receive a musical instrument where the musical instrument is a recorder, where the recorder has a bore and a first end and a second end and a length and a top, wherein the support platform slot is narrower than the hole and is configured to allow a narrow portion of the length of said recorder to pass into the hole wherein the hole is larger than the support platform slot and is smaller than the top of the recorder such that the first end of the recorder is supported by the top of the support platform; and d. a stand connector where the stand connector is located in the attachment recess such that the support platform is selectively horizontally securable to a stand when said stand is located in said attachment recess.

11. The apparatus of claim 10 wherein the hole is configured to receive a recorder selected from a group of recorders consisting of: soprano, alto and tenor.

12. The apparatus of claim 10 further including more than one hole in said support platform.

13. The apparatus of claim 12 wherein there are three holes in said support platform.

14. The apparatus of claim 13 wherein the three holes are configured to receive different sizes of a recorder.

15. The apparatus of claim 13 wherein the three holes are configured to receive one each of a selection of recorders consisting of a soprano, an alto and a tenor recorder.

16. The apparatus of claim 10 wherein the support platform further includes a connection arm integral to the support platform where the attachment recess is in said connection arm.

17. A method for selectively securing a musical instrument in a holder comprising:

a. providing a support platform with a top, a bottom and a side; an attachment recess in said support platform where said attachment recess is integral to the support platform and includes an attachment recess slot in the side; a hole in said support platform and a support platform slot connected with said hole where said hole is configured to receive a musical instrument, where the musical instrument has a bore and a first end and a second end and a length and a top, wherein the support platform slot is narrower than said hole and is configured to allow a narrow portion of the length of said musical instrument to pass into the hole wherein the hole is larger than the support platform slot and is smaller than the top of the musical instrument such that the first end of the musical instrument is supported by the top of the support platform; and b. providing a stand connector where the stand connector is located in the attachment recess such that the support platform is selectively securable to a stand when said stand is located in said attachment recess.

18. The method of claim 17 wherein the hole is configured to support a musical instrument wherein the musical instrument is a recorder selected from a group of recorders consisting of: soprano, alto and tenor.

19. The method of claim 17 wherein there are three holes configured to receive a soprano recorder, an alto recorder and a tenor recorder.

20. The method of claim 17, wherein the support platform is curved with a circular dimension.

* * * * *